US010297195B2

(12) United States Patent
Feng

(10) Patent No.: US 10,297,195 B2
(45) Date of Patent: May 21, 2019

(54) PIXEL CIRCUIT AND DRIVING METHOD THEREOF, ARRAY SUBSTRATE, DISPLAY PANEL AND DISPLAY DEVICE

(71) Applicants: BOE TECHNOLOGY GROUP CO., LTD., Beijing (CN); ORDOS YUANSHENG OPTOELECTRONICS CO., LTD., Ordos (CN)

(72) Inventor: Yu Feng, Beijing (CN)

(73) Assignees: BOE Technology Group Co., Ltd., Beijing (CN); Ordos Yuansheng Optoelectronics Co., Ltd., Ordos (CN)

( * ) Notice: Subject to any disclaimer, the term of this patent is extended or adjusted under 35 U.S.C. 154(b) by 16 days.

(21) Appl. No.: 15/522,388

(22) PCT Filed: Dec. 31, 2015

(86) PCT No.: PCT/CN2015/100230
§ 371 (c)(1),
(2) Date: Apr. 27, 2017

(87) PCT Pub. No.: WO2017/031909
PCT Pub. Date: Mar. 2, 2017

(65) Prior Publication Data

US 2017/0330511 A1 Nov. 16, 2017

(30) Foreign Application Priority Data

Aug. 21, 2015 (CN) ..... 2015 1 0520061

(51) Int. Cl.
*G09G 3/3233* (2016.01)

(52) U.S. Cl.
CPC ... *G09G 3/3233* (2013.01); *G09G 2300/0819* (2013.01); *G09G 2310/0251* (2013.01);
(Continued)

(58) Field of Classification Search
None
See application file for complete search history.

(56) References Cited

U.S. PATENT DOCUMENTS 9,373,281 B2 * 6/2016 Wu ..... G09G 3/3233
2009/0225011 A1 9/2009 Choi
(Continued)

FOREIGN PATENT DOCUMENTS

CN 101339737 A 1/2009
CN 102222465 A 10/2011
(Continued)

OTHER PUBLICATIONS

Office Action from corresponding Chinese Application No. 201510520061.5, dated Oct. 21, 2016 (7 pages).
(Continued)

*Primary Examiner* — Kenneth B Lee, Jr.
(74) *Attorney, Agent, or Firm* — Harness, Dickey & Pierce, P.L.C.

(57) ABSTRACT

Embodiments of the present disclosure provide a pixel circuit and a driving method thereof, an array substrate, a display panel, and a display device. In the pixel circuit, the drive module drives the light emission module to emit light. The storage module stores the control voltage required for the drive module. The reset module resets the control voltage stored in the storage module. The data write module writes the data voltage to the storage module. The compensation module compensates for the threshold voltage of the drive module and to compensate for the control voltage stored in the storage module. The light emission control module controls the driving of the drive module to the light emission module. The operating current flowing through the electroluminescent element may not be affected by the threshold voltage of the drive transistor.

20 Claims, 5 Drawing Sheets

(52) U.S. Cl.
CPC ..... *G09G 2310/061* (2013.01); *G09G 2320/0233* (2013.01); *G09G 2320/045* (2013.01); *G09G 2330/02* (2013.01)

(56) References Cited

U.S. PATENT DOCUMENTS

| | | | |
|---|---|---|---|
| 2011/0109531 | A1 | 5/2011 | Choi |
| 2011/0164016 | A1 | 7/2011 | Kang et al. |
| 2011/0279437 | A1 | 11/2011 | Komiya et al. |
| 2012/0235972 | A1 | 9/2012 | Liu et al. |
| 2014/0292740 | A1 | 10/2014 | Tseng et al. |
| 2016/0372049 | A1 | 12/2016 | Wang et al. |

FOREIGN PATENT DOCUMENTS

| | | | |
|---|---|---|---|
| CN | 102243839 | A | 11/2011 |
| CN | 102832229 | A | 12/2012 |
| CN | 102930824 | A | 2/2013 |
| CN | 203882588 | U | 10/2014 |
| CN | 104157240 | A | 11/2014 |
| CN | 204029330 | U | 12/2014 |
| CN | 105161051 | A | 12/2015 |
| TW | 201437992 | A | 10/2014 |

OTHER PUBLICATIONS

Written Opinion of the International Searching Authority from corresponding PCT Application No. PCT/CN2015/100230, dated May 20, 2016 (5 pages).

* cited by examiner

PIXEL CIRCUIT AND DRIVING METHOD THEREOF, ARRAY SUBSTRATE, DISPLAY PANEL AND DISPLAY DEVICE

CROSS-REFERENCE TO RELATED APPLICATION

This application claims the benefit and priority of Chinese Patent Application No. 201510520061.5, filed on Aug. 21, 2015, the entire content of which is incorporated by reference herein in its entirety as part of the present application.

BACKGROUND

The present disclosure relates to the field of display technology, and particularly, to a pixel circuit and a driving method thereof, an array substrate, a display panel, and a display device.

Organic Light-Emitting Diode (OLED) display is one of the focuses in the current researching field of the flat panel display. Compared with Liquid Crystal Display (LCD), OLED display has advantages, such as low energy consumption, low production cost, wide viewing angle and fast response and so on. At present, in the display areas like mobile phone, Personal Digital Assistant (PDA) and digital camera, OLED display has begun to replace the conventional liquid crystal display. In the OLED display technology, the design of pixel circuit is the core technology content, and has important research significance.

Unlike Thin Film Field Effect Transistor-Liquid Crystal Displays (TFT-LCDs) that utilize stable voltage to control luminance, OLEDs are current-driven devices that require a stable current to control the light emitting luminance. However, due to the manufacturing process, the aging of devices and other reasons, there is unevenness between the threshold voltages of the drive transistors in pixel circuits in the prior art, with 2T1C driving circuit (comprising two thin film field effect transistors and one capacitor), resulting in a change in the current flowing through the OLED in each pixel circuit so that the display luminance is uneven, thereby affecting the display effect of the entire image.

SUMMARY

Embodiments of the present disclosure provide a pixel circuit and a driving method thereof, an array substrate, a display panel and a display device.

According to a first aspect, embodiments of the present disclosure provide a pixel circuit comprising: a light emission module, a drive module, a storage module, a reset module, a data write module, a compensation module and a light emission control module. The drive module is configured to drive the light emission module to emit light. The storage module is connected to the drive module and is configured to store the control voltage required for the drive module. The reset module is connected to the storage module and is configured to reset the control voltage stored in the storage module. The data write module is connected to the storage module and is configured to write the data voltage to the storage module. The compensation module is connected to the storage module and the drive module and is configured to compensate for the threshold voltage of the drive module and to compensate for the control voltage stored in the storage module. The light emission control module is connected to the drive module and the light emission module and is configured to control the driving of the drive module to the light emission module.

In embodiments of the present disclosure, the compensation module comprises a second switch transistor and a fourth switch transistor. The control electrode of the second switch transistor is connected to a second input terminal, and the drive module is connected between the first electrode and the second electrode of the second switch transistor. A control electrode of the fourth switch transistor is connected to a third input terminal, a first electrode of the fourth switch transistor is connected to the storage module, and a second electrode of the fourth switch transistor is connected to a second voltage input terminal.

In embodiments of the present disclosure, the reset module comprises a first switch transistor. The data write module comprises a third switch transistor. The light emission control module comprises a fifth switch transistor. The drive module comprises a drive transistor. The storage module comprises a capacitor. The light emission module comprises an electroluminescent element. A control electrode of the first switch transistor is connected to the first input terminal, a first electrode of the first switch transistor is connected to the first electrode of the second switch transistor, the first electrode of the drive transistor and the first electrode of the fifth transistor, and a second electrode of the first switch transistor is connected to a reset voltage input terminal. The second electrode of the second switch transistor is connected to the control electrode of the drive transistor and the first terminal of the capacitor. A second electrode of the drive transistor is connected to the first voltage input terminal. A control electrode of the third switch transistor is connected to the second input terminal, a first electrode of the third switch transistor is connected to the second terminal of the capacitor and the first electrode of the fourth switch transistor, and a second electrode of the third switch transistor is connected to a data signal input terminal. A control electrode of the fifth switch transistor is connected to a third input terminal, and a second electrode of the fifth switch transistor is connected to the electroluminescent element.

In embodiments of the present disclosure, turn-on electric levels of the second switch transistor and the third switch transistor are the same.

In embodiments of the present disclosure, the control electrode of the second switch transistor and the control electrode of the third switch transistor are connected to the same input terminal.

In embodiments of the present disclosure, turn-on electric levels of the fourth switch transistor and the fifth switch transistor are the same.

In embodiments of the present disclosure, the control electrode of the fourth switch transistor and the control electrode of the fifth switch transistor are connected to the same input terminal.

In embodiments of the present disclosure, each of the switch transistors is a P-type transistor.

In embodiments of the present disclosure, the drive transistor is a P-type transistor.

According to a second aspect, embodiments of the present disclosure provide a method for driving any one of the preceding pixel circuits, comprising: in a first stage, resetting the control voltage stored in the storage module by the reset module; in a second stage, writing the data voltage to the storage module by the data write module, compensating for the threshold voltage of the drive module by the compensation module, and storing the control voltage in the storage module; in the third stage, compensating for the control voltage stored in the storage module by the compensation module, controls the driving of the drive module to the light emission module by the light emission control module, and driving the light emission module to emit light by the drive module.

In embodiments of the present disclosure, the method comprise: in the first stage, applying a reset voltage to the second electrode of the first switch transistor of the reset module; applying control signals to the control electrode of the first switch transistor, the control electrode of the second switch transistor of the compensation module, and the control electrode of the third switch transistor of the data write module, so as to turn on the first switch transistor, the second switch transistor and the third switch transistor; applying control signals to the control electrode of the fourth switch transistor of the compensation module and the control electrode of the fifth switch transistor of the light emission control module, so as to turn off the fourth switch transistor and the fifth switch transistor; in the second stage, applying an operation voltage to the second electrode of the drive transistor of the drive module, and applying a data voltage to the second electrode of the third switch transistor, applying control signals to the control electrode of the second switch transistor and the control electrode of the third switch transistor so as to turn on the second switch transistor and the third switch transistor; applying control signals to the control electrode of the first switch transistor, the control electrode of the fourth switch transistor, and the control electrode of the fifth switch transistor, so as to turn off the first switch transistor, the fourth switch transistor and the fifth switch transistor. In the third stage, applying an operation voltage to the second electrode of the drive transistor, and applying a reference voltage to the second electrode of the fourth switch transistor; applying control signals to the control electrode of the fourth switch transistor and the control electrode of the fifth switch transistor, so as to turn on the fourth switch transistor and the fifth switch transistor; applying control signals to the control electrode of the first switch transistor, the control electrode of the second switch transistor and the control electrode of the third switch transistor, so as to turn off the first switch transistor, the second switch transistor, and the third switch transistor.

According to a third aspect, embodiments of the present disclosure provide an array substrate comprising of any one of the preceding pixel circuits.

According to a fourth aspect, embodiments of the present disclosure provide a display panel comprising the above-mentioned array substrate.

According to a fifth aspect, embodiments of the present disclosure provide a display device comprising the above-mentioned display panel.

In the pixel circuit provided by the embodiments of the present disclosure, the operating current flowing through the electroluminescent element may not be affected by the threshold voltage of the drive transistor, thus may completely solve the problem of display luminance unevenness due to the threshold voltage drift of the drive transistor.

BRIEF DESCRIPTION OF THE DRAWINGS

In order to more clearly illustrate the technical solution of the embodiments of the present disclosure, the drawings of the embodiments will be briefly described below. It should be understood that the drawings described below merely relate to some embodiments of the present disclosure, rather than limit the present disclosure, wherein.

DETAILED DESCRIPTION

To make the technical solutions and advantages of the embodiments of the present disclosure clearer, the technical solutions in the embodiments of the present disclosure will be clearly and completely described below in conjunction with the accompanying drawings in the embodiments of the present disclosure. Obviously, the embodiments described are merely a part of the present disclosure, rather than all of the embodiments. All other embodiments obtained by those skilled in the art based on embodiments of the disclosure, without making creative efforts, are within the scope of the present disclosure.

Figure 1:
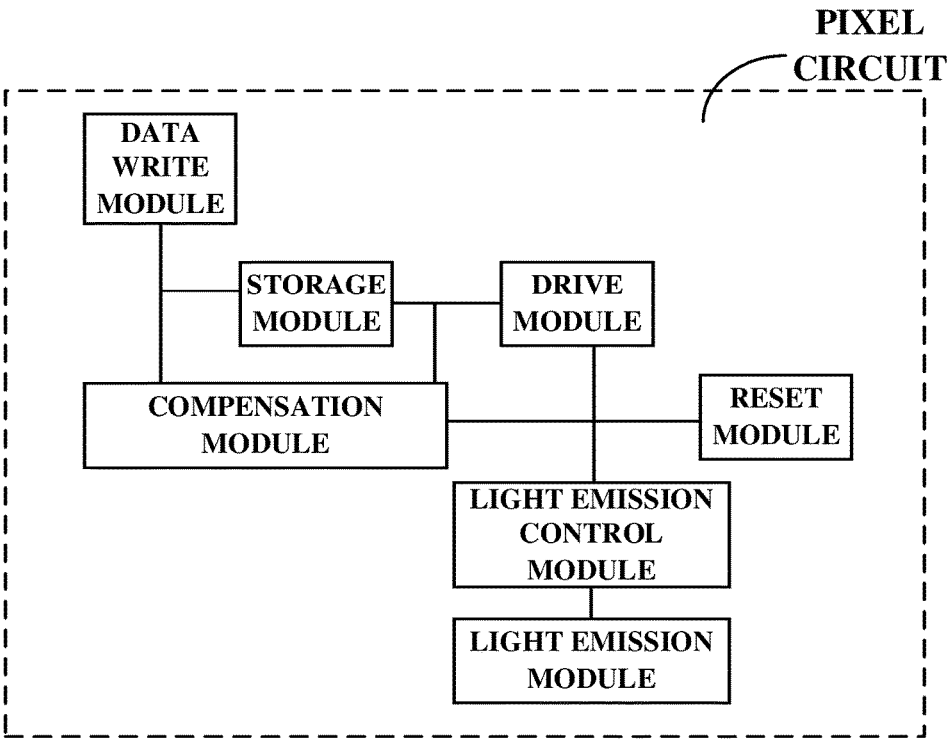
FIG. 1 is a block diagram of a pixel circuit according to a first embodiment of the present disclosure.

FIG. 1 is a block diagram of a pixel circuit according to a first embodiment of the present disclosure. As shown in FIG. 1, the pixel circuit of the present embodiment comprises a light emission module, a drive module, a storage module, a reset module, a data write module, a compensation module and a light emission control module. The drive module is configured to drive the light emission module to emit light. The storage module is connected to the drive module and is configured to store the control voltage required for the drive module. The reset module is connected to the storage module and is configured to reset the control voltage stored in the storage module. The data write module is connected to the storage module and is configured to write the data voltage to the storage module. The compensation module is connected to the storage module and is configured to compensate for the threshold voltage of the drive module and to compensate for the control voltage stored in the storage module. The light emission control module is connected to the drive module and the light emission module and is configured to control the driving of the drive module to the light emission module.

Figure 2:
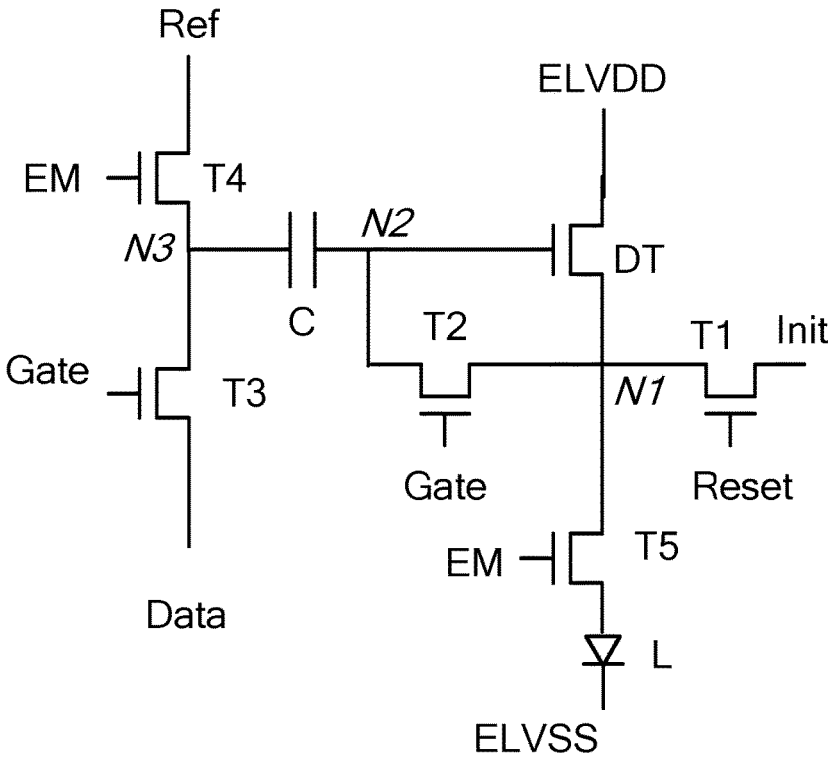
FIG. 2 is a schematic circuit diagram of the pixel circuit of the embodiment shown in FIG. 1.

FIG. 2 is a schematic circuit diagram of the pixel circuit of the embodiment shown in FIG. 1. As shown in FIG. 2, in the pixel circuit, the reset module comprises a first switch transistor T1. The compensation module comprises a second switch transistor T2 and a fourth switch transistor T4. The data write module comprises a third switch transistor T3. The light emission control module comprises a fifth switch transistor T5. The drive module comprises a drive transistor DT. The storage module comprises a capacitor C. The light emission module comprises an electroluminescent element L. The first electrode of the first switch transistor T1, the first electrode of the second switch transistor T2, the first electrode of the drive transistor DT and the first electrode of the fifth switch transistor T5 are connected to each other, and the connection point thereof forms the first node N1. The second electrode of the second switch transistor T2, the gate of the drive transistor DT and the first terminal of the capacitor C are connected to each other, and the connection point thereof forms the second node N2. The first electrode of the third transistor T3, the first electrode of the fourth switch transistor T4 and the second terminal of the capacitor C are connected to each other, and the connection point thereof forms the third node N3. The second electrode of the fifth switch transistor T5 is connected to the anode of the electroluminescent element L. In addition, each of the gates of the respective switch transistors, the second electrodes of switch transistors other than the second switch transistor T2 and the fifth switch transistor T5, the second electrode of the drive transistor DT and the cathode of the electroluminescent element L is connected to an input terminal. Specifically, the gate of the first switch transistor T1 is connected to the first input terminal Reset, and the second electrode thereof is connected to the reset voltage input terminal Init. The gate of the second switch transistor T2 and the gate of the third switch transistor T3 are connected to the second input terminal Gate. The second electrode of the third switch transistor T3 is connected to the data signal input terminal Data. The gate of the fourth switch transistor T4 and the gate of the fifth switch transistor T5 are connected to the third input terminal EM. The second electrode of the fourth switch transistor T4 is connected to the second voltage input terminal Ref. The second electrode of the drive transistor DT is connected to the first voltage input terminal ELVDD. The cathode of the electroluminescent element L is connected to the third voltage input terminal ELVSS.

It is not difficult to understand that, in the embodiments of the present disclosure, the gate of a switch transistor is a control electrode for control, the first electrode thereof refers to one of the source and drain electrodes of the switch transistor, and the second electrode refers to the other of the source and drain electrodes. For different switch transistors, the electrodes represented by the first electrode may be the same and may not be the same, and the electrodes represented by the corresponding second electrode may be the same and may not be the same. For example, for one switch transistor, the first electrode may represent the source, the second electrode may represent the drain; while for another switch transistor, the first electrode may represent the drain, and the second electrode may represent the source. Under the premise that the corresponding functions can be completed, the scope of protection of the present disclosure would not be affected no matter which electrode should be used as the first electrode and which electrode as the second electrode, and the corresponding technical solution should fall within the scope of protection of the present disclosure.

In the pixel circuit provided by the embodiments of the present disclosure, the operating current flowing through the electroluminescent element may not be affected by the threshold voltage of the drive transistor, thus may completely solve the problem of display luminance unevenness due to the threshold voltage drift of the drive transistor. The driving method and the working principle of the pixel circuit provided in the embodiments of the present disclosure will be briefly described below in conjunction with FIGS. 3-6.

Figure 3:
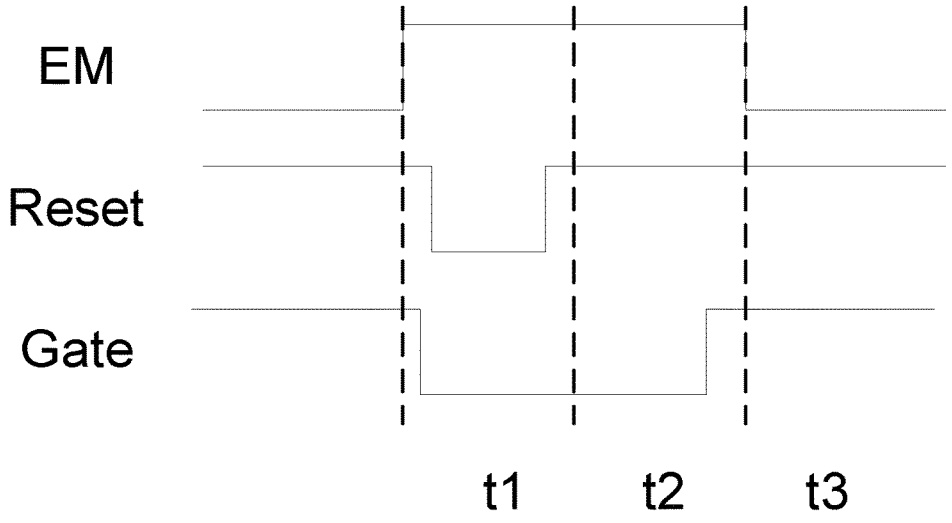
FIG. 3 is a timing diagram of signals provided to the pixel circuit shown in FIG. 2.

FIG. 3 is a timing diagram of signals provided to the pixel circuit shown in FIG. 2. In the embodiments of the present disclosure, a constant high level operation voltage may be applied to the first voltage input terminal ELVDD shown in FIG. 2, a constant low level operation voltage may be applied to the third voltage input terminal ELVSS, and a constant preset voltage may be applied to the second voltage input terminal Ref. In addition, in this example, corresponding to a P-type drive transistor DT, a constant low level voltage may be applied to the reset voltage input terminal Init. The voltages applied to these input terminals do not change with time and will not be shown in FIG. 3.

As shown in FIG. 3, when the pixel circuit is used to display an image, the driving process of the pixel circuit can be divided into three stages.

The first stage t1 is a reset phase in which a low level signal is applied to the first input terminal Reset and the second input terminal Gate, and a high level signal is applied to the third input terminal EM. The first switch transistor T1 and the second switch transistor T2 are turned on. The third switch transistor T3 is also turned on. The fourth switch transistor T4 and the fifth switch transistor T5 are turned off.

Figure 4:
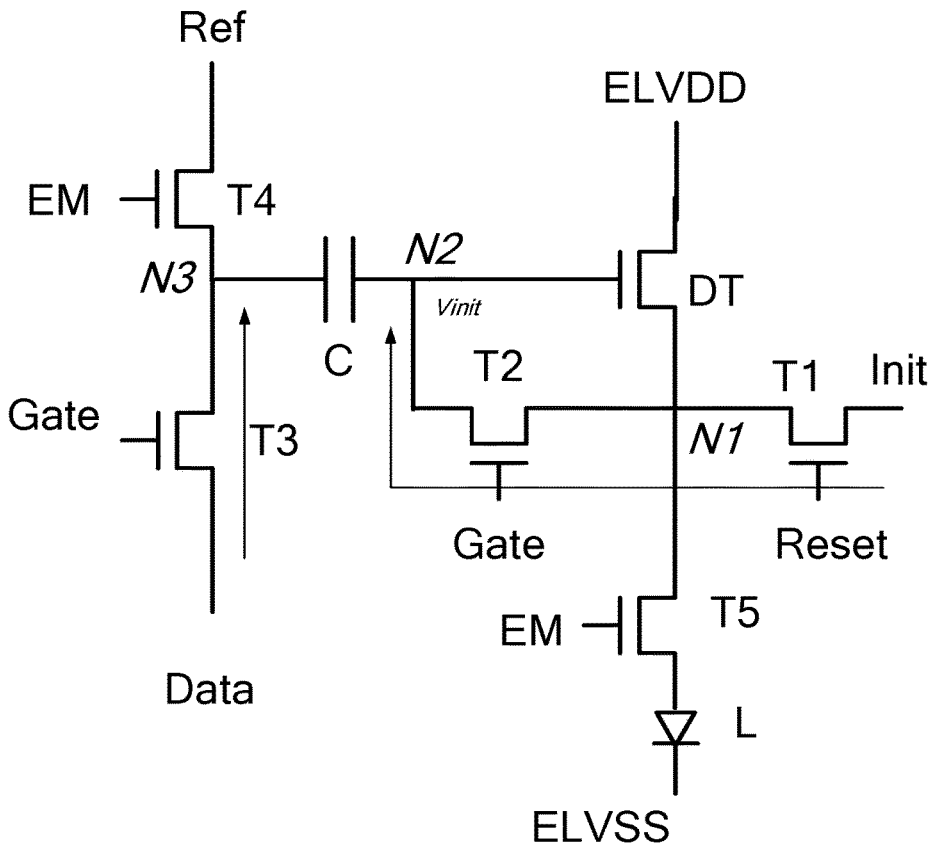
FIG. 4 is a schematic diagram of the direction of the current flow and voltage values of the nodes of the pixel circuit shown in FIG. 2 in the first stage.

FIG. 4 is a schematic diagram of the direction of the current flow and voltage values of the nodes of the pixel circuit shown in FIG. 2 in the first stage. Referring to FIG. 4, the second node N2 is connected to the reset voltage input terminal Init, and the voltage of the second node N2 is reset to the reset voltage (set to Vinit) applied to the reset voltage input terminal Init, thus preventing the voltage, which is applied to the second node N2 when the previous frame image is displayed, from affecting the display of the current frame image. In addition, due to the manufacturing process, a capacitor may be formed in the drive transistor DT, and some charge may be stored in the capacitor, which also affects the light emitting luminance of the pixel circuit when used for displaying the current frame image. In the embodiments of the present disclosure, when the second switch transistor T2 is turned on, the voltage of the first node N1 is also reset to avoid the influence of the charge accumulated on the drive transistor DT.

The second stage t2 is a threshold compensation and data voltage writing stage in which a data voltage is applied to the data signal input terminal, a low level signal is applied to the second input terminal Gate, and a high level signal is applied to the first input terminal Reset and the third input terminal EM. The second switch transistor T2 and the third switch transistor T3 are turned on, and the other switch transistors are turned off.

Figure 5:
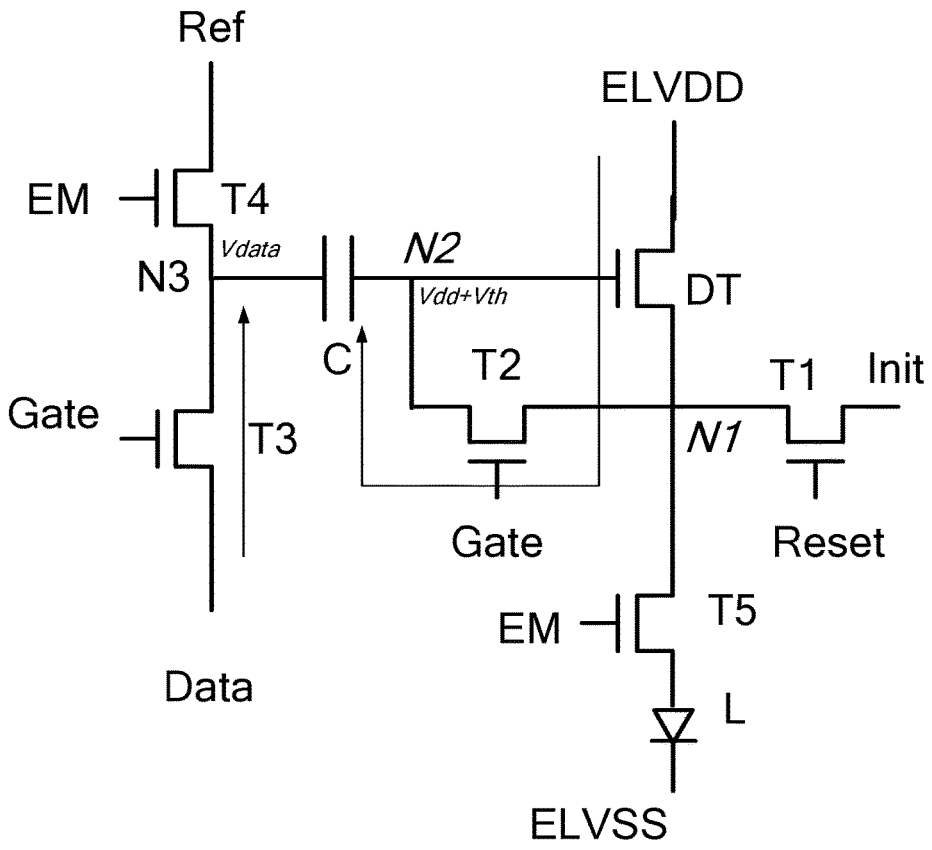
FIG. 5 is a schematic diagram of the direction of the current flow and voltage values of the nodes of the pixel circuit shown in FIG. 2 in the second stage.

FIG. 5 is a schematic diagram of the direction of the current flow and voltage values of the nodes of the pixel circuit shown in FIG. 2 in the second stage. Referring to FIG. 5, at this time, the third node N3 is connected to the data signal input terminal Data, and the voltage of the third node N3 is set to the data voltage (set to Vdata) applied to the data signal input terminal Data. The drive transistor DT is turned on, the high level operation voltage (set to Vdd) applied to the first voltage input terminal ELVDD charges the second node N2 via the drive transistor DT and the second switch transistor T2, and after the charging is completed, the voltage of the second node N2 is Vdd+Vth, wherein Vth is the threshold voltage of the drive transistor DT (the threshold of the P-type drive transistor is generally negative). The voltage difference across the capacitor C is Vdd+Vth−Vdata. Thus, the voltage of the second node N2 is set to a value related to the threshold voltage of the drive transistor DT. Then, in the light emission stage of the subsequent process, the threshold voltage of the drive transistor DT can be eliminated from the voltage of the second node N2, preventing the threshold voltage of the drive transistor DT from affecting the light emission display.

The third stage t3 is a jump-transition and light emission stage in which a reference voltage is applied to the second voltage input terminal Ref, a high level signal is applied to the first input terminal Reset and the second input terminal Gate, and a low level signal is applied to the third input terminal EM. At this time, the fourth switch transistor T4 and the fifth switch transistor T5 are turned on. The first switch transistor T1, the second switch transistor T2, and the third switch transistor T3 are turned off.

Figure 6:
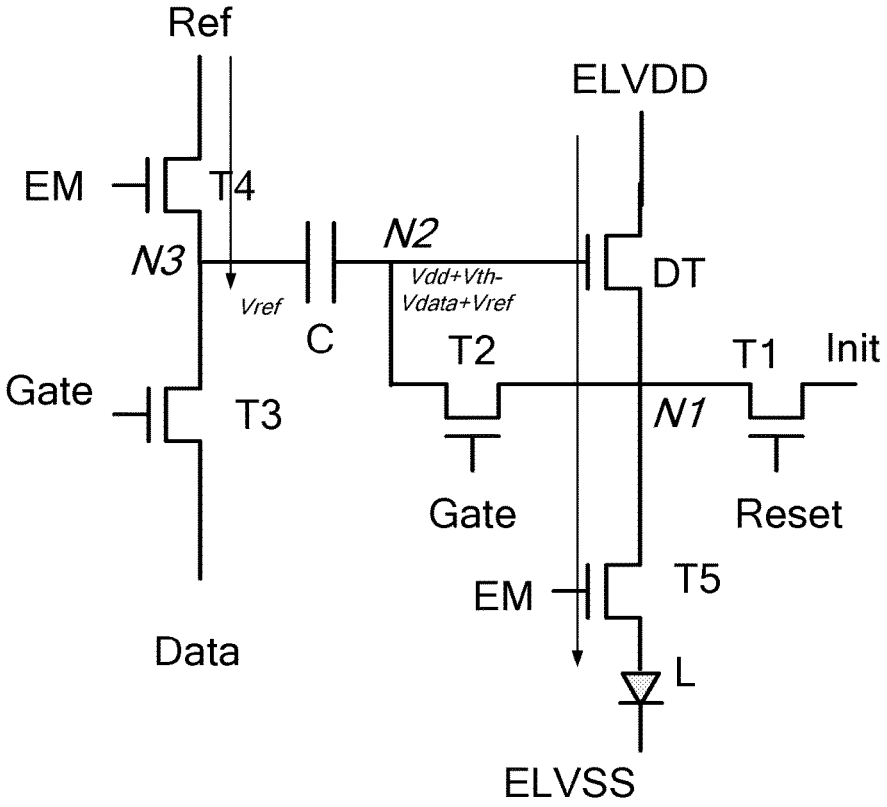
FIG. 6 is a schematic diagram of the direction of the current flow and voltage values of the nodes of the pixel circuit shown in FIG. 2 in the third stage.

FIG. 6 is a schematic diagram of the direction of the current flow and voltage values of the nodes of the pixel circuit shown in FIG. 2 in the third stage. Referring to FIG. 6, at this time, the third node N3 is connected to the second voltage input terminal Ref, the voltage of the third node N3 changes to the reference voltage (set to Vref) applied to the second voltage input terminal Ref, i.e., the voltage at the second terminal of the capacitor C changes to Vref. Since the capacitor has a property to keep the voltage difference at both ends not abruptly changed, the voltage difference Vdd+Vth−Vdata at both ends of the capacitor C remains unchanged. The voltage at the first end of the capacitor C undergoes an isobaric transition, and is transitioned to Vdd+Vth−Vdata+Vref, i.e., the voltage of the second node N2 is transitioned to Vdd+Vth−Vdata+Vref. Thus the drive transistor DT continues to be turned on, and the anode of the electroluminescent element L is connected to the first voltage input terminal ELVDD via the fifth switch transistor T5 and the drive transistor DT. According to the current saturation formula, the current flowing through the electroluminescent element L is:

$$I_L = K \cdot (V_{GS} + Vth)^2 = K \cdot (Vdd - (Vdd + Vth - Vdata + Vref + Vth)^2$$
$$= K \cdot (Vref - Vdata)^2$$

wherein K is a constant related to the drive transistor DT. It can be seen from the above formula that the operating current flowing through the electroluminescent element L at this time is not affected by the threshold Vth of the drive transistor and is only related to the data voltage Vdata and the reference voltage Vref applied to the second voltage input terminal Ref. The effect of the drift of the threshold Vth to the current flowing through the electroluminescent element is completely avoided, so as to ensure the normal operation of the electroluminescent element. Those skilled in the art can reasonably select values of Vdata, Vref, and Vdd according to the application environment, as long as the drive transistor DT can be continuously turned on in the second stage t2 and the third stage t3, and there is no further limitation thereto.

Also, in the embodiments of the present disclosure, the second node N2 connected to the gate of the drive transistor DT is only connected to one switch transistor T2, thereby effectively reducing the leakage of the second node N2 in the display light emission stage to ensure the luminance of the pixel unit unchanged in the light emission stage.

Figure 7:
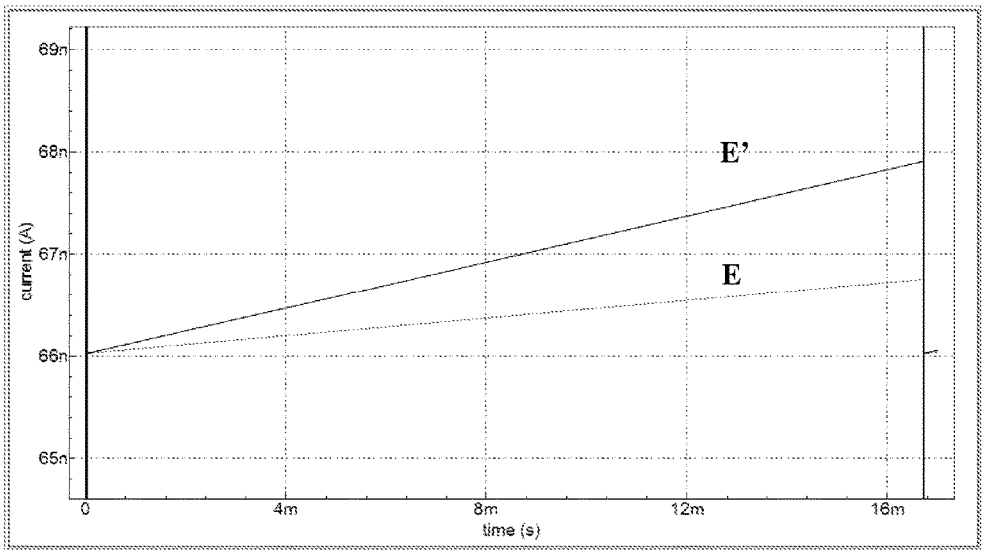
FIG. 7 is a graph of the temporal variation of light emitting luminance of the pixel circuit of the prior art and light emitting luminance of the pixel circuit provided in the embodiments of the present disclosure.

FIG. 7 is a graph of the temporal variation of light emitting luminance of the pixel circuit of the prior art and light emitting luminance of the pixel circuit provided in the embodiment of the present disclosure. It can be seen that the light emitting luminance E of the pixel circuit provided by the embodiments of the present disclosure varies little with time as compared with the light emitting luminance E' of the pixel circuit in the prior art during the light emission process.

In the above embodiments, the gate of the second switch transistor T2 and the gate of the third switch transistor T3 are connected to the same input terminal, the gate of the fourth switch transistor T4 and the gate of the fifth switch transistor T5 are connected to the same input terminal. In this way, the number of signal lines used to drive the pixel circuit (one input terminal corresponding to one signal line) and the drive difficulty may be reduced. It is not difficult to understand that it is also possible to achieve the basic object of the present disclosure by connecting the above-mentioned switch transistors to the corresponding input terminals one-to-one, and the corresponding technical solutions should fall within the scope of protection of the present disclosure.

In the above-described embodiments, all the switch transistors are P-type transistors so that the manufacturing processes may be unified, so as to facilitate reducing the manufacturing difficulty. Of course, in practical applications, the above-mentioned switch transistors may be totally or partially replaced by N-type transistors. It is not difficult to understand that, when the above-mentioned second switch transistor T2 and the third switch transistor T3 both are P-type transistors or N-type transistors, the two switch transistors may also be connected to the same input terminal to reduce the number of signal lines required for driving the pixel circuit. As long as the turn-on electric levels of the second switch transistor T2 and the third switch transistor T3 are the same, that is, the same high level or the same low level, both transistors can be connected to the same input terminal. Here the turn-on electric levels are the same high level means that each of the two transistors is turned on when the voltage accessed to the gate is higher than the corresponding threshold voltage so that a suitable high voltage may be chosen to turn on the both; accordingly, the turn-on electric levels are the same low level means that each of the two transistors is turned on when the voltage accessed to the gate is less than the corresponding threshold voltage. Accordingly, the fourth switch transistor T4 and the fifth switch transistor T5 both may be P-type transistors or N-type transistors and are connected to the same input terminal. Also, the drive transistor DT may also be an N-type transistor, and the reset voltage Vinit applied to the input terminal Init at this time is a high level voltage.

The above-described driving method is described by examples of the case where the input terminals Ref, ELVDD, ELVSS, and Init are connected to a constant voltage. However, in practice, a corresponding voltage may be applied at the input terminal only when the switch transistor corresponding to the input terminal is turned on. In this way, the basic object of the present disclosure can also be achieved, and the corresponding technical solution should fall within the scope of protection of the present disclosure.

The electroluminescent element L herein may be specifically an organic electroluminescent element and may also be any other light-emitting element controlled by voltage or current to emit light.

According to a second embodiment of the present disclosure, there is provided an array substrate comprising the above-described pixel circuit.

According to a third embodiment of the present disclosure, there is provided a display panel comprising the above-described array substrate.

According to a fourth embodiment of the present disclosure, there is provided a display device comprising the above-described display panel.

The display device here may be any display product or component having display function, such as electronic paper, mobile phone, tablet, TV, monitor, notebook, digital photo frame and navigator.

The forgoing is merely about the specific embodiments of the present disclosure, but the scope of protection of the present disclosure is not limited thereto, and any change or substitution easily conceivable to those skilled in the art within the technical scope of the disclosure disclosed, should be encompassed within the scope of protection of the present disclosure. Accordingly, the scope of protection of the present disclosure should be based on the scope of protection of the claims.

What is claimed is:

1. A pixel circuit comprising:

a light emission circuit, a drive circuit, a storage circuit, a reset circuit, a data write circuit, a compensation circuit and a light emission control circuit;

wherein the drive circuit is configured to drive the light emission circuit to emit light;

wherein the storage circuit is connected to the drive circuit and is configured to store a control voltage required for the drive circuit;

wherein the reset circuit is connected to the storage circuit and is configured to reset the control voltage stored in the storage circuit;

wherein the data write circuit is connected to the storage circuit and is configured to write a data voltage to the storage circuit;

wherein the compensation circuit is connected to the storage circuit and the drive circuit, and is configured to compensate for a threshold voltage of the drive circuit and compensate for the control voltage stored in the storage circuit; and wherein the light emission control circuit is connected to the drive circuit and the light emission circuit, and is configured to allow the drive circuit to drive the light emission circuit.

2. The pixel circuit according to claim 1, wherein the compensation circuit comprises a second switch transistor and a fourth switch transistor;

wherein a control electrode of the second switch transistor is connected to a second input terminal, and the drive circuit is connected between a first electrode and a second electrode of the second switch transistor; and wherein a control electrode of the fourth switch transistor is connected to a third input terminal, a first electrode of the fourth switch transistor is connected to the storage circuit, and a second electrode of the fourth switch transistor is connected to a second voltage input terminal.

3. The pixel circuit according to claim 2, wherein the reset circuit comprises a first switch transistor, the data write circuit comprises a third switch transistor, the light emission control circuit comprises a fifth switch transistor, the drive circuit comprises a drive transistor; the storage circuit comprises a capacitor, and the light emission circuit comprises an electroluminescent element;

wherein a control electrode of the first switch transistor is connected to a first input terminal, a first electrode of the first switch transistor is connected to the first electrode of the second switch transistor, a first electrode of the drive transistor and a first electrode of the fifth transistor, and a second electrode of the first switch transistor is connected to a reset voltage input terminal;

wherein the second electrode of the second switch transistor is connected to a control electrode of the drive transistor and a first terminal of the capacitor;

wherein a second electrode of the drive transistor is connected to a first voltage input terminal;

wherein a control electrode of the third switch transistor is connected to the second input terminal, a first electrode of the third switch transistor is connected to a second terminal of the capacitor and the first electrode of the fourth switch transistor, and a second electrode of the third switch transistor is connected to a data signal input terminal; and wherein a control electrode of the fifth switch transistor is connected to the third input terminal, and a second electrode of the fifth switch transistor is connected to the electroluminescent element.

4. The pixel circuit according to claim 3, wherein turn-on electric levels of the second switch transistor and the third switch transistor are the same.

5. The pixel circuit according to claim 4, wherein the control electrode of the second switch transistor and the control electrode of the third switch transistor are connected to the same input terminal.

6. The pixel circuit according to claim 3, wherein turn-on electric levels of the fourth switch transistor and the fifth switch transistor are the same.

7. The pixel circuit according to claim 6, wherein the control electrode of the fourth switch transistor and the control electrode of the fifth switch transistor are connected to the same input terminal.

8. The pixel circuit according to claim 3, wherein each of the switch transistors is a P-type transistor.

9. The pixel circuit according to claim 3, wherein the drive transistor is a P-type transistor.

10. A method for driving a pixel circuit of claim 1 comprising:

in a first stage, resetting, by the reset circuit, the control voltage stored in the storage circuit;

in a second stage, writing, by the data write circuit, the data voltage to the storage circuit, compensating, by the compensation circuit, for the threshold voltage of the drive circuit, and storing the control voltage in the storage circuit; and in a third stage, compensating, by the compensation circuit, for the control voltage stored in the storage circuit, controlling, by the light emission control circuit, the driving of the drive circuit to the light emission circuit, and driving, by the drive circuit, the light emission circuit to emit light.

11. The method according to claim 10, further comprising:

in the first stage, applying a reset voltage to a second electrode of a first switch transistor of the reset circuit, applying control signals to a control electrode of the first switch transistor, a control electrode of a second switch transistor of the compensation circuit, and a control electrode of a third switch transistor of the data write circuit, to turn on the first switch transistor, the second switch transistor and the third switch transistor, and applying control signals to a control electrode of a fourth switch transistor of the compensation circuit and a control electrode of a fifth switch transistor of the light emission control circuit, to turn off the fourth switch transistor and the fifth switch transistor;

in the second stage, applying an operation voltage to a second electrode of a drive transistor of the drive circuit, applying a data voltage to a second electrode of the third switch transistor, applying control signals to the control electrode of the second switch transistor and the control electrode of the third switch transistor to turn on the second switch transistor and the third switch transistor, and applying control signals to the control electrode of the first switch transistor, the control electrode of the fourth switch transistor, and the control electrode of the fifth switch transistor to turn off the first switch transistor, the fourth switch transistor and the fifth switch transistor; and in the third stage, applying an operation voltage to the second electrode of the drive transistor, applying a reference voltage to a second electrode of the fourth switch transistor, applying control signals to the control electrode of the fourth switch transistor and the control electrode of the fifth switch transistor to turn on the fourth switch transistor and the fifth switch transistor, and applying control signals to the control electrode of the first switch transistor, the control electrode of the second switch transistor and the control electrode of the third switch transistor to turn off the first switch transistor, the second switch transistor, and the third switch transistor.

12. An array substrate comprising the pixel circuit according to claim 1.

13. A display panel comprising the array substrate according to claim 12.

14. A display device comprising the display panel according to claim 13.

15. The array substrate according to claim 12, wherein the compensation circuit comprises a second switch transistor and a fourth switch transistor;

wherein a control electrode of the second switch transistor is connected to a second input terminal, and the drive circuit is connected between a first electrode and a second electrode of the second switch transistor; and wherein a control electrode of the fourth switch transistor is connected to a third input terminal, a first electrode of the fourth switch transistor is connected to the storage circuit, and a second electrode of the fourth switch transistor is connected to a second voltage input terminal.

16. The array substrate according to claim 15, wherein the reset circuit comprises a first switch transistor, the data write circuit comprises a third switch transistor, the light emission control circuit comprises a fifth switch transistor, the drive circuit comprises a drive transistor; the storage circuit comprises a capacitor, and the light emission circuit comprises an electroluminescent element;

wherein a control electrode of the first switch transistor is connected to a first input terminal, a first electrode of the first switch transistor is connected to the first electrode of the second switch transistor, a first electrode of the drive transistor and a first electrode of the fifth transistor, and a second electrode of the first switch transistor is connected to a reset voltage input terminal;

wherein the second electrode of the second switch transistor is connected to a control electrode of the drive transistor and a first terminal of the capacitor;

wherein a second electrode of the drive transistor is connected to a first voltage input terminal;

wherein a control electrode of the third switch transistor is connected to the second input terminal, a first electrode of the third switch transistor is connected to a second terminal of the capacitor and the first electrode of the fourth switch transistor, and a second electrode of the third switch transistor is connected to a data signal input terminal; and wherein a control electrode of the fifth switch transistor is connected to the third input terminal, and a second electrode of the fifth switch transistor is connected to the electroluminescent element.

17. The array substrate according to claim 16, wherein turn-on electric levels of the second switch transistor and the third switch transistor are the same.

18. The array substrate according to claim 17, wherein the control electrode of the second switch transistor and the control electrode of the third switch transistor are connected to the same input terminal.

19. The array substrate according to claim 16, wherein turn-on electric levels of the fourth switch transistor and the fifth switch transistor are the same.

20. The array substrate according to claim 19, wherein the control electrode of the fourth switch transistor and the control electrode of the fifth switch transistor are connected to the same input terminal.

* * * * *